US009733597B1

(12) United States Patent
Umetsu et al.

(10) Patent No.: US 9,733,597 B1
(45) Date of Patent: Aug. 15, 2017

(54) IMAGE FORMING APPARATUS USING RESIDUAL HEAT OF HEATING MEMBER IN OTHER JOBS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventors: Toshiyuki Umetsu, Fuji Shizuoka (JP); Katsuya Endo, Fuji Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/255,306

(22) Filed: Sep. 2, 2016

(51) Int. Cl.
*G03G 15/00* (2006.01)
*G03G 15/20* (2006.01)

(52) U.S. Cl.
CPC ..... *G03G 15/2039* (2013.01); *G03G 15/2078* (2013.01)

(58) Field of Classification Search
CPC ..... G03G 15/2039; G03G 15/2078; G03G 15/50; G03G 15/5012
See application file for complete search history.

(56) References Cited

U.S. PATENT DOCUMENTS

2014/0055546 A1* 2/2014 Imamiya ..... G03G 15/205 347/179
2015/0185652 A1* 7/2015 Mimura ..... G03G 15/0131 399/27

FOREIGN PATENT DOCUMENTS

JP 2016-057362 4/2016

* cited by examiner

*Primary Examiner* — Hoang Ngo
(74) *Attorney, Agent, or Firm* — Amin, Turocy & Watson LLP

(57) ABSTRACT

An image forming apparatus comprises an image forming section which forms an image on an image receiving medium with a color material; a heating member which heats the image receiving medium; a heater which heats the heating member; a sensor which detects a temperature of the heating member; and a controller which executes a print job for forming an image on the image receiving medium with the image forming section and fixing the image on the image receiving medium with the heating member and a decoloring job for decoloring the image on the image receiving medium with the heating member and interruptedly executes an executable job in a state of stopping output of the heater if the temperature of the heating member is higher than a temperature control range of a job of which priority is highest and there is the executable job at the temperature of the heating member.

10 Claims, 6 Drawing Sheets

FIG.7

IN CASE WHERE UPPER LIMIT TEMPERATURE IS (A)

(1) DECOLORING JOB (FIRST JOB) → NON-DECOLORABLE PRINT JOB (SECOND JOB) → DECOLORING JOB (FIRST JOB)

(2) DECOLORABLE PRINT JOB (FIRST JOB) → NON-DECOLORABLE PRINT JOB (SECOND JOB) → DECOLORABLE PRINT JOB (FIRST JOB)

(3) DECOLORABLE PRINT JOB (FIRST JOB) → NON-DECOLORABLE PRINT JOB (THIRD JOB) → DECOLORING JOB (SECOND JOB) → DECOLORABLE PRINT JOB (FIRST JOB)

(4) DECOLORABLE PRINT JOB (FIRST JOB) → DECOLORING JOB (SECOND JOB) → DECOLORABLE PRINT JOB (FIRST JOB)

IN CASE WHERE UPPER LIMIT TEMPERATURE IS (B)

(5) NON-DECOLORABLE PRINT JOB (FIRST JOB) → DECOLORING JOB (SECOND JOB) → NON-DECOLORABLE PRINT JOB (FIRST JOB)

(6) DECOLORABLE PRINT JOB (FIRST JOB) → DECOLORING JOB (SECOND JOB) → DECOLORABLE PRINT JOB (FIRST JOB)

(7) DECOLORABLE PRINT JOB (FIRST JOB) → DECOLORING JOB (THIRD JOB) → NON-DECOLORABLE PRINT JOB (SECOND JOB) → DECOLORABLE PRINT JOB (FIRST JOB)

(8) DECOLORABLE PRINT JOB (FIRST JOB) → NON-DECOLORABLE PRINT JOB (SECOND JOB) → DECOLORABLE PRINT JOB (FIRST JOB)

IN CASE WHERE UPPER LIMIT TEMPERATURE IS (C)

(9) DECOLORABLE PRINT JOB (FIRST JOB) → DECOLORING JOB (SECOND JOB) → DECOLORABLE PRINT JOB (FIRST JOB)

(10) NON-DECOLORABLE PRINT JOB (FIRST JOB) → DECOLORING JOB (SECOND JOB) → NON-DECOLORABLE PRINT JOB (FIRST JOB)

(11) NON-DECOLORABLE PRINT JOB (FIRST JOB) → DECOLORING JOB (THIRD JOB) → DECOLORABLE PRINT JOB (SECOND JOB) → NON-DECOLORABLE PRINT JOB (FIRST JOB)

(12) NON-DECOLORABLE PRINT JOB (FIRST JOB) → DECOLORABLE PRINT JOB (SECOND JOB) → NON-DECOLORABLE PRINT JOB (FIRST JOB)

IMAGE FORMING APPARATUS USING RESIDUAL HEAT OF HEATING MEMBER IN OTHER JOBS

FIELD

Embodiments described herein relate generally to a technology of using residual heat of a heating member.

BACKGROUND

In an image forming apparatus, if print jobs are continuously executed, there is a case in which the temperature of a heat roller is higher than a temperature control range. In this case, the image forming apparatus stops or terminates the execution of the print job and stops output of a heater of a fixing device. Consequently, the image forming apparatus idles the heat roller in a state of contact with a pressure roller and radiates the heat of the heat roller until the temperature of the heat roller is within the temperature control range. There is also a method of using a fan to cool the heat roller.

There is a problem of high cost associated with excessive cooling time and a problem of wasting power consumption in the method of cooling the heat roller through idling the heat roller. There is a problem that the cost is taken as a fan is necessary and a problem of wasting too much power consumption in the method of cooling the heat roller through the fan.

DESCRIPTION OF THE DRAWINGS

FIG. 7 is a diagram illustrating a combination of a first job to a third job and a processing procedure of the jobs.

DETAILED DESCRIPTION

Figure 1:
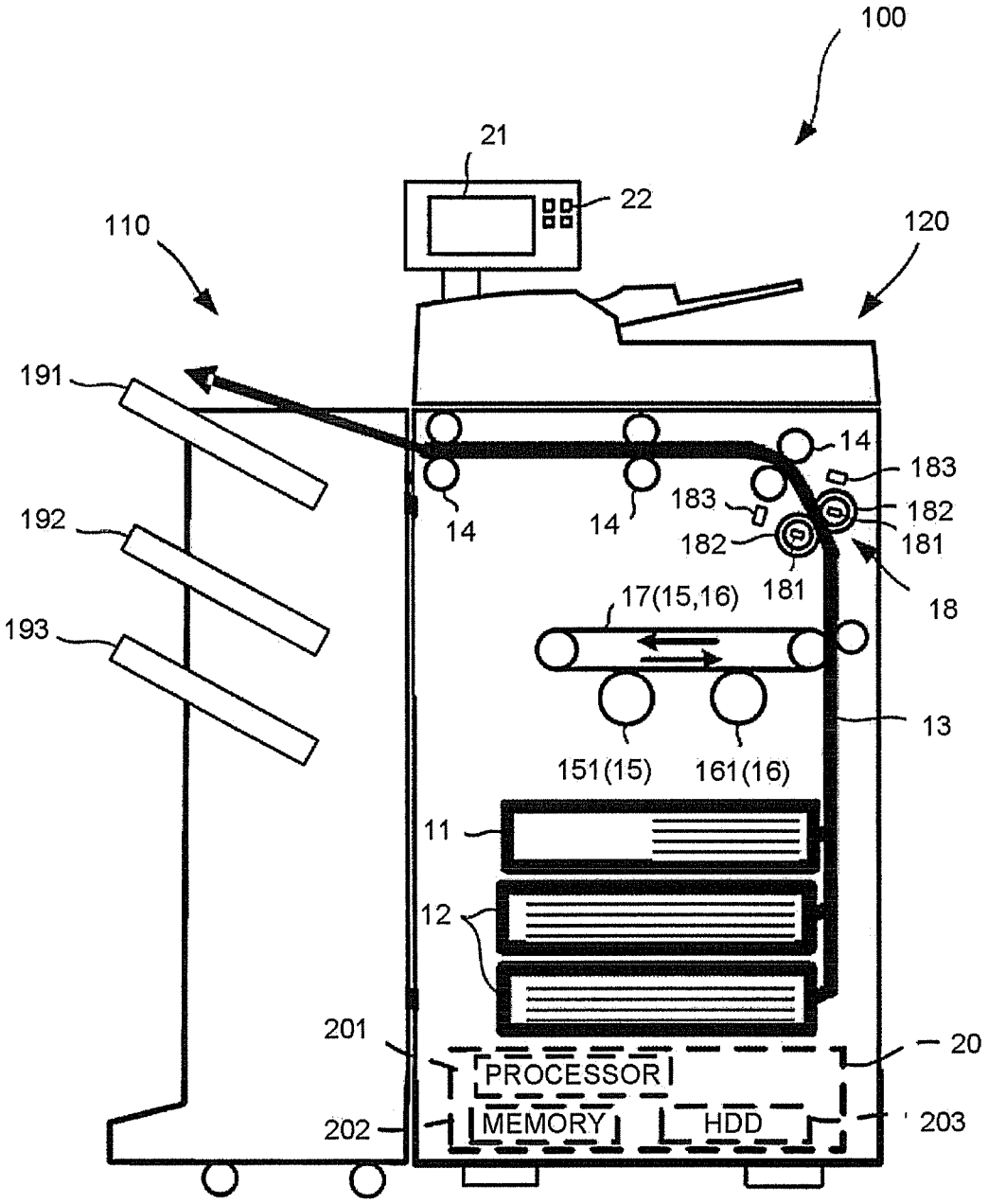
FIG. 1 is a diagram illustrating the configuration of an image forming apparatus.

Generally, in accordance with an embodiment, an image forming apparatus comprises an image forming section, a heating member, a heater, a sensor and a controller. The image forming section forms an image on an image receiving medium with a color material. The heating member heats the image receiving medium. The heater heats the heating member. The sensor detects a temperature of the heating member. The controller, which executes a print job for forming an image on the image receiving medium with the image forming section and fixing the image on the image receiving medium with the heating member and a decoloring job for decoloring the image on the image receiving medium with the heating member, interruptedly executes an executable job in a state of stopping output of the heater in a case in which the temperature of the heating member is higher than a temperature control range of a job of which priority is highest and there is the executable job at the temperature of the heating member.

Generally, in accordance with an embodiment, an image forming apparatus comprises a first image forming section, a second image forming section, a heating member, a heater, a sensor and a controller. The first image forming section forms an image on an image receiving medium with a non-decolorable color material. The second image forming section forms an image on the image receiving medium with a decolorable color material. The heating member heats the image receiving medium. The heater heats the heating member. The sensor detects the temperature of the heating member. The controller, which executes a non-decolorable print job for forming an image on the image receiving medium with the non-decolorable color material through the first image forming section and fixing the image on the image receiving medium with the heating member and a decolorable print job for forming an image on the image receiving medium with the decolorable color material through the second image forming section and fixing the image on the image receiving medium with the heating member, interruptedly executes an executable job in a state of stopping output of the heater in a case in which the temperature of the heating member is higher than a temperature control range of a job of which priority is highest and there is the executable job at the temperature of the heating member.

Generally, in accordance with an embodiment, a method of executing a job is executed by an image forming apparatus comprising a heating member for heating an image receiving medium and a heater for heating the heating member. The method includes detecting a temperature of the heating member and interruptedly executing an executable job in a state of stopping output of the heater in a case in which the detected temperature of the heating member is higher than a temperature control range of a job of which priority is highest and there is the executable job at the temperature of the heating member between a print job for forming an image on the image receiving medium and fixing the image on the image receiving medium with the heating member and a decoloring job for decoloring the image on the image receiving medium with the heating member.

Hereinafter, the embodiment is described with reference to the accompanying drawings.

FIG. 1 is a diagram illustrating the configuration of an image forming apparatus 100.

The image forming apparatus 100 can execute a non-decolorable print job, a decolorable print job and a decoloring job. The non-decolorable print job refers to an act of forming an image on a sheet with a non-decolorable color material and heating the sheet (image receiving medium) to fix the image on the image receiving medium. The decolorable print job refers to an act of forming an image on a sheet with a decolorable color material and heating the sheet to fix the image on the image receiving medium. The decoloring job refers to an act of decoloring the image on the sheet formed with the decolorable color material.

The decolorable color material is toner, for example, and includes a color developing compound, a color developing agent and a decoloring agent in addition to resin. Leuco dyes developing blue color are exemplified as the color developing compound. Phenols are exemplified as the color developing agent. A matter which is blended with the color developing compound if heated and has no affinity to the color developing agent is exemplified as the decoloring agent. The decolorable color material develops color through interaction between the color developing compound and the color developing agent and is decolored as the interaction between the color developing compound and the color developing agent is cut off by the heating at a temperature higher than or equal to a decoloring temperature.

The "decoloring" refers to making an image formed with a color (containing not only chromatic colors but also achromatic colors such as white, black and the like) different from a base color of the sheet invisible visually or difficult to be visually seen. The "invisible visually" refers to making the image formed with the color different from the base color of the sheet change to a color identical or similar to the base color of the sheet in addition to a form in which the image formed with the color different from the base color of the sheet is colorless (transparent).

The non-decolorable color material is an ordinary color material not for the purpose of decoloration, and is, for example, a toner not including the color developing agent and the decoloring agent. The non-decolorable color material for K contains carbon as the color developing agent in addition to the resin.

The sheet is a paper, an envelope, a transparency and the like.

The image forming apparatus 100 is equipped with paper feed cassettes 11 and 12, a conveyance path 13, a conveyance roller 14, a first image forming section 15, a second image forming section 16, a heat source 18, paper discharge trays 191~193, a controller 20, a display 21 and an operation section 22. Among the above components, the paper discharge trays 191~193 are arranged in a finisher 110, and the other components are arranged in an apparatus main body 120.

The paper feed cassette 11 stacks sheets serving as printing processing objects.

The paper feed cassette 12 stacks sheets serving as reuse processing objects on each of which an image is formed with the decolorable color material.

The conveyance path 13 is a path of the sheet from the paper feed cassettes 11 and 12 to the paper discharge trays 191~193 and guides the sheet towards the downstream side.

The conveyance roller 14 is positioned at a proper position in the conveyance path 13 to send the sheet to the downstream side.

The first image forming section 15 forms an image on the sheet with the non-decolorable color material. The first image forming section 15 forms an image only with the non-decolorable color material entirely in black; however, the first image forming section 15 may form the image with the non-decolorable color materials of a plurality of colors. The first image forming section 15 develops an electrostatic latent image formed on a first photoconductor 151 through a laser optical system with the non-decolorable color material through the developing device. The first image forming section 15 transfers a toner image on the transfer belt 17 onto the sheet after transferring the toner image on the first photoconductor 151 onto the transfer belt 17.

The second image forming section 16 forms an image with the decolorable color material on the sheet. The second image forming section 16 forms an image only with the decolorable color material entirely in blue; however, the second image forming section 16 may form the image with the decolorable color material of a plurality of colors. The second image forming section 16 develops an electrostatic latent image formed on a second photoconductor 161 through the laser optical system with the decolorable color material through the developing device. The second image forming section 16 transfers a toner image on the transfer belt 17 onto the sheet after transferring the toner image on the second photoconductor 161 onto the transfer belt 17. The transfer belt 17 serves as the component of the first image forming section 15 and as also the component of the second image forming section 16. If a transfer position from the transfer belt 17 onto the sheet is set as an end point in a rotational direction of the transfer belt 17, the second photoconductor 161 is positioned at the downstream side (transfer position side of the end point) of the first photoconductor 151. The second photoconductor 161 may be positioned at the upstream side of the first photoconductor 151.

The heat source 18 is equipped with a heater 181, a heat roller 182 and a temperature sensor 183.

The heater 181 is positioned in the heat roller 182 and heats the heat roller 182.

A pair of the heat rollers 182 contacts with each surface of the sheet. The heat roller 182 includes a function of heating the sheet on which the first and the second image forming sections 15 and 16 form images to fix the images on the sheet and a function of heating the sheet on which an image is formed with the decolorable color material to decolor the image.

The temperature sensor 183 is arranged in the heat roller 182 or in the vicinity thereof to detect a temperature of the heat roller 182. The controller 20 controls output of the heater 181 based on output of the temperature sensor 183. The controller 20 increases, lowers or keeps the temperature of the heat roller 182 to make the temperature of the heat roller 182 reach a target temperature control range.

The conveyance rollers 14 are arranged at various positions in the conveyance path 13. The conveyance roller 14 sends the sheet passing through the heat source 18 to the finisher 110.

The finisher 110 discharges the sheet on which an image is formed with the non-decolorable color material to the paper discharge tray 191. The finisher 110 discharges the sheet on which an image is formed with the decolorable color material to the paper discharge tray 192. The finisher 110 discharges the sheet subjected to a decoloring processing to the paper discharge tray 193.

The controller 20 is equipped with a processor 201, a memory 202 and an HDD 203 (Hard Disk Drive), and controls the whole of the image forming apparatus 100. The processor 201 executes programs stored in the memory 202 and the HDD 203 to realize various functions of the image forming apparatus 100.

The display 21 displays setting information and an operation status of the image forming apparatus 100, log information and notification to a user.

The operation section 22 includes buttons and keys to receive an input of the user.

Figure 2:
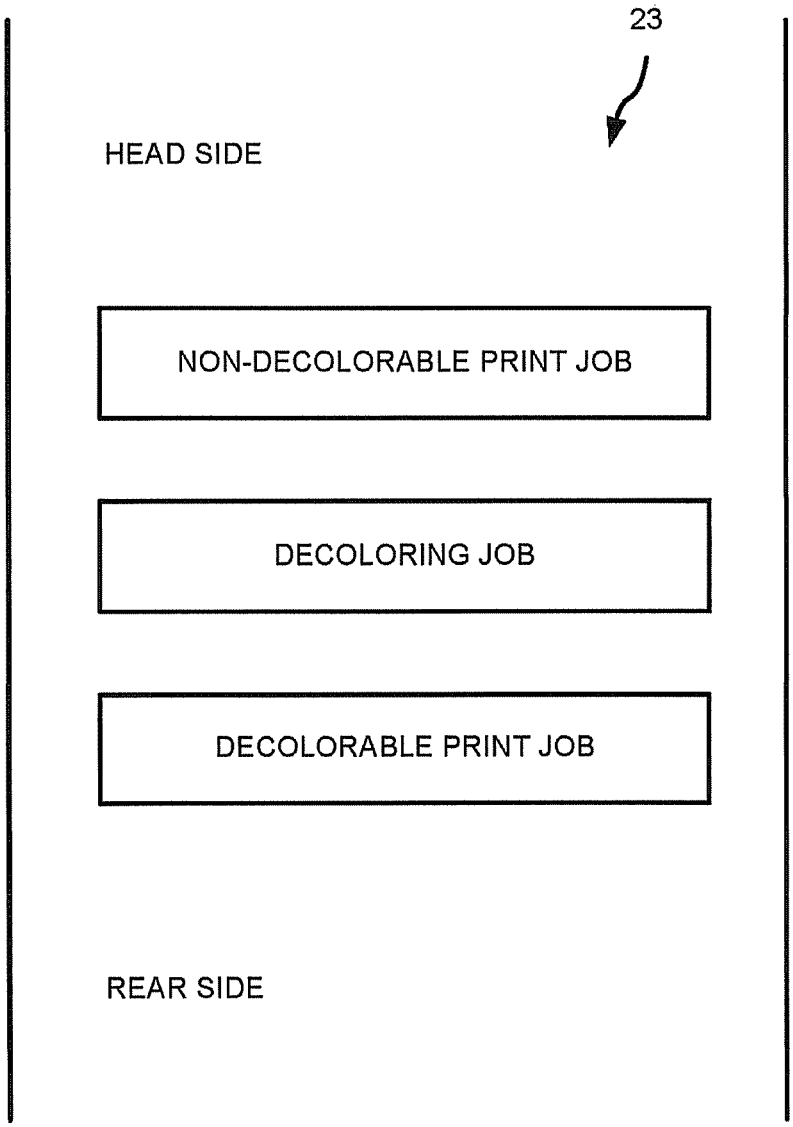
FIG. 2 is a diagram illustrating a job queue in an HDD.

FIG. 2 is a diagram illustrating a job queue 23 in the HDD 203.

If receiving an execution instruction of jobs, the controller 20 registers the jobs in the job queue 23 which is a storage area in the HDD 203 in order of reception. The controller 20 executes the jobs in order from the head side in the job queue 23 and deletes the completed job from the job queue 23.

At the time of executing the non-decolorable print job, the controller 20 picks out the sheet from the paper feed cassette 11, and forms an image on the sheet with the non-decolorable color material by the first image forming section 15. The controller 20 controls the heater 181 in such a way that the temperature of the heat roller 182 is within the temperature control range of the job. The controller 20 heats the sheet with the heat roller 182 to fix the image on the sheet. The finisher 110 discharges the sheet to the paper discharge tray 191.

At the time of executing the decolorable print job, the controller 20 picks out the sheet from the paper feed cassette 11, and forms an image on the sheet with the decolorable color material by the second image forming section 16. The controller 20 controls the heater 181 in such a way that the temperature of the heat roller 182 is within the temperature control range of the job. The controller 20 heats the sheet with the heat roller 182 to fix the image on the sheet. The finisher 110 discharges the sheet to the paper discharge tray 192.

At the time of executing the decoloring job, the controller 20 picks out the sheet on which the image is formed with the decolorable color material from the paper feed cassette 12. The controller 20 controls the heater 181 in such a way that the temperature of the heat roller 182 is within the temperature control range of the job. The controller 20 heats the sheet with the heat roller 182 to decolor the image formed with the decolorable color material on the sheet. The finisher 110 discharges the sheet to the paper discharge tray 193.

Figure 3:
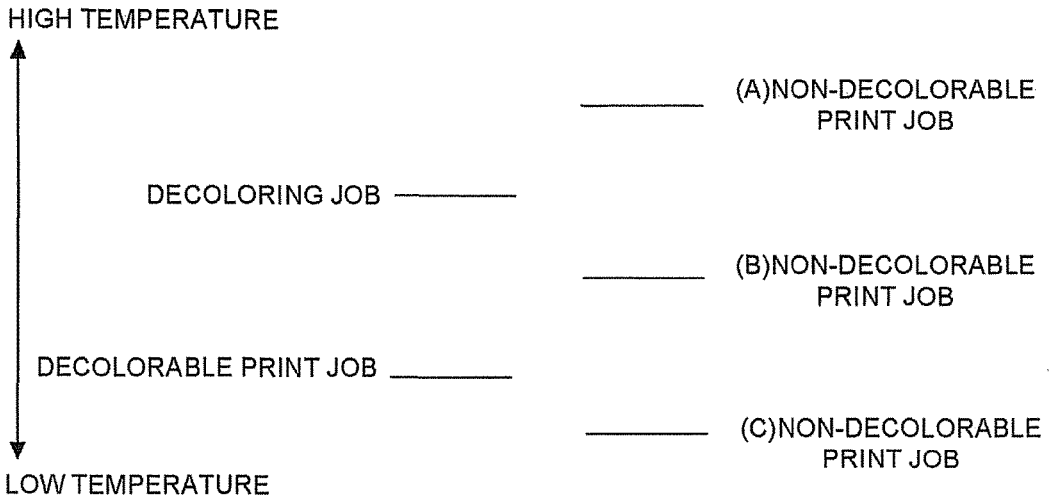
FIG. 3 is a diagram illustrating an example of a temperature control range of each job.

FIG. 3 is a diagram illustrating an upper limit temperature of the temperature control range of each job.

Hereinafter, an upper limit temperature of the temperature control range of the heat roller 182 in each job is simply referred to as an upper limit temperature, and a lower limit temperature of the temperature control range is simply referred to as a lower limit temperature in some cases.

Although the upper limit temperature of each job varies depending on used toner or toner serving as decoloring object, the upper limit temperature of the decoloring job is higher than the upper limit temperature of the decolorable print job. The upper limit temperature of the non-decolorable print job has following (A)~(C) patterns with respect to the upper limit temperature of the decoloring job and the upper limit temperature of the decolorable print job.

(A) The upper limit temperature of the non-decolorable print job is higher than the upper limit temperature of the decoloring job.

(B) The upper limit temperature of the non-decolorable print job is lower than the upper limit temperature of the decoloring job and higher than the upper limit temperature of the decolorable print job.

(C) The upper limit temperature of the non-decolorable print job is lower than the upper limit temperature of the decolorable print job.

For example, in a case of (A), the temperature control range of the non-decolorable print job is 90 degrees centigrade~180 degrees centigrade, and the upper limit temperature thereof is 180 degrees centigrade. The temperature control range of the decoloring job is 150 degrees centigrade~160 degrees centigrade, and the upper limit temperature thereof is 160 degrees centigrade. The temperature control range of the decolorable print job is 100 degrees centigrade~120 degrees centigrade and the upper limit temperature thereof is 120 degrees centigrade.

Generally, the image forming apparatus cools the heat roller with a fan or enables the heat roller to naturally radiate the heat therein if the temperature of the heat roller exceeds the upper limit temperature at the time of executing the job. The image forming apparatus restarts the job if the temperature of the heat roller is equal to or lower than the upper limit temperature.

In the present embodiment, the controller 20 stops the heater 181 if the temperature of the heat roller 182 exceeds the upper limit temperature at the time of executing the job. The controller 20 uses a difference of the upper limit temperatures of jobs to execute other jobs in a state of stopping the heater 181 and uses residual heat of the heat roller 182. In this way, in the present embodiment, energy conservation and shortening of execution time of total jobs is promoted.

In other words, the controller 20 interruptedly executes an executable job in a state of stopping the output of the heater in a case in which the temperature of the heat roller 182 is higher than the temperature control range of a job of which priority is highest and there is the executable job at the temperature of the heat roller 182. The job of which the priority is highest refers to a job at the head of the job queue 23.

Hereinafter, the execution processing of jobs by the controller 20 is described with reference to the flowchart in FIG. 4.

The controller 20 executes a first job (Act 1). The first job is any one of the non-decolorable print job, the decolorable print job and the decoloring job. The first job is, for example, the decolorable print job.

The controller 20 reserves the first job and stops the output of the heater 181 (Act 2) in a case in which the temperature of the heat roller 182 exceeds the upper limit temperature of the first job. Reserving the job refers to stopping the execution of the job and making the job transit from an active state to an execution waiting state.

The controller 20 enables a second job which is executable at the temperature of the heat roller 182 to interrupt the head of the job queue 23 (Act 3). The second job is any one of the non-decolorable print job, the decolorable print job and the decoloring job. The upper limit temperature of the second job is higher than the upper limit temperature of the first job. The second job is, for example, the decoloring job.

Further, in Act 3, the second job which is executable at the temperature of the heat roller 182 is a job that becomes executable with the temperature of the heat roller 182 lowering as time elapses. That is, the second job is a job the upper limit temperature of which is equal to or lower than the temperature of the heat roller 182 and higher than the first job that is being executed. In a case in which the second job is a job the upper limit temperature of which is equal to or lower than the temperature of the heat roller 182 and higher than the first job that is being executed, the following processing is executed in Acts 3 and 4.

In Act 3, the controller 20 waits for until the temperature of the heat roller 182 is equal to or lower than the upper limit temperature of the second job after the interruption of the second job is executed. Then, the controller 20 executes the second job in Act 4 described later.

The controller 20 uses the residual heat of the heat roller 182 to execute the second job in a state of stopping the output of the heater 181.

In the execution of the second job, as the temperature of the heat roller 182 lowers, the supply amount of the heat to the sheet from the heat roller 182 is reduced as the time elapses.

Thus, the controller 20 may slow a conveyance speed of the heat roller 182 with respect to the conveyance speed of the heat roller 182 at the time of the second job normally executed through the output of the heater 181. In this way, contact time between the heat roller 182 and the sheet is increased, and the sheet can be sufficiently heated. At this time, the controller 20 gradually slows the conveyance speed of the heat roller 182 along with the temperature of the heat roller 182 that decreases.

In a case in which the upper limit temperature of the first job is higher than the lower limit temperature of the second job, the controller 20 reserves the second job if the temperature of the heat roller 182 is lower than the upper limit temperature of the first job through executing the second job.

In a case in which the upper limit temperature of the first job is lower than the lower limit temperature of the second job, the controller 20 reserves the second job if the temperature of the heat roller 182 is lower than the lower limit temperature of the second job. In a case in which the temperature of the heat roller 182 is not lower than the lower limit temperature of the second job, the controller 20 completes the second job. Then, the controller 20 enables the temperature of the heat roller 182 to be equal to or lower than the upper limit temperature of the first job through enabling the heat roller 182 to naturally radiate the heat thereof.

The controller 20 returns the first job to the active state (Act 4).

The controller 20 starts the output of the heater 181 to restart the interrupted first job (Act 5). The controller 20 restarts the second job after the completion of the first job in a case of reserving the second job.

Next, other execution processing of the jobs by the controller 20 is described with reference to the flowchart in FIG. 5. In the present processing, the residual heat of the heat roller 182 is used in the third job in addition to the use in the second job. The third job is any one of the non-decolorable print job, the decolorable print job and the decoloring job, and the upper limit temperature thereof is higher than the upper limit temperatures of the first and the second jobs. In a case of the example of (A) in FIG. 3 in which the upper limit temperature of the non-decolorable print job is highest, as shown in FIG. 6, the third job is the non-decolorable print job.

The controller 20 executes the first job (Act 11). The first job is, for example, the decolorable print job.

The controller 20 reserves the first job and stops the output of the heater 181 (Act 12) in a case in which the temperature of the heat roller 182 exceeds the upper limit temperature of the first job.

The controller 20 enables the third job the upper limit temperature of which is higher between the second job and the third job which are executable at the temperature of the heat roller 182 to interrupt the head of the job queue 23 (Act 13). The second job is, for example, the decoloring job, and the third job is, for example, the non-decolorable print job. In Act 13, the third job which is executable at the temperature of the heat roller 182 is a job which becomes executable with the temperature of the heat roller 182 lowering as the time elapses.

The controller 20 uses the residual heat of the heat roller 182 to execute the third job in a state of stopping the output of the heater 181. The controller 20 may slow the conveyance speed of the sheet in the execution of the third job compared with the third job that is normally executed.

In a case shown in FIG. 6 in which the upper limit temperature of the second job is higher than the lower limit temperature of the third job, the controller 20 reserves the third job if the temperature of the heat roller 182 is lower than the upper limit temperature of the second job through executing the third job.

In a case in which the upper limit temperature of the second job is lower than the lower limit temperature of the third job, the controller 20 reserves the third job if the temperature of the heat roller 182 is lower than the lower limit temperature of the third job. The controller 20 completes the third job in a case in which the temperature of the heat roller 182 is not lower than the lower limit temperature of the third job. Then, the controller 20 enables the temperature of the heat roller 182 to be equal to or lower than the upper limit temperature of the second job through enabling the heat roller 182 to naturally radiate the heat thereof.

The controller 20 enables the second job to interrupt the head of the job queue 23 (Act 14).

The controller 20 executes the second job. The controller 20 may slow the conveyance speed of the sheet in the execution of the second job compared with the second job that is normally executed.

In a case in which the upper limit temperature of the first job is higher than the lower limit temperature of the second job, the controller 20 reserves the second job if the temperature of the heat roller 182 is lower than the upper limit temperature of the first job through executing the second job.

In a case shown in FIG. 6 in which the upper limit temperature of the first job is lower than the lower limit temperature of the second job, the controller 20 reserves the second job if the temperature of the heat roller 182 is lower than the lower limit temperature of the second job. The controller 20 completes the second job in a case in which the temperature of the heat roller 182 is not lower than the lower limit temperature of the second job. Then, the controller 20 enables the temperature of the heat roller 182 to be equal to or lower than the upper limit temperature of the first job through enabling the heat roller 182 to naturally radiate the heat thereof.

The controller 20 returns the first job to the active state (Act 15).

The controller 20 starts the output of the heater 181 to restart the interrupted first job (Act 16). The controller 20 restarts the reserved second and third jobs in order after the first job is completed in a case of reserving the second and third jobs.

FIG. 7 is a diagram illustrating a combination of the first to the third jobs and a processing procedure of the jobs.

In a case of (A) shown in FIG. 3 in which the upper limit temperature of the non-decolorable print job is higher than the upper limit temperature of the decoloring job, following (1)~(4) combinations are considered as the combinations of the first to the third jobs and the processing procedures of the jobs. The controller 20 executes the processing in order from the job at the left side to the job at the right side.

(1) The decoloring job-the non-decolorable print job-the decoloring job (2) The decolorable print job-the non-decolorable print job-the decolorable print job (3) The decolorable print job-the non-decolorable print job-the decoloring job-the decolorable print job (4) The decolorable print job-the decoloring job-the decolorable print job In a case of (B) shown in FIG. 3 in which the upper limit temperature of the non-decolorable print job is lower than the upper limit temperature of the decoloring job and higher than the upper limit temperature of the decolorable print job, following (5)~(8) combinations are considered as the combinations of the first to the third jobs and the processing procedures of the jobs.

(5) The non-decolorable print job-the decoloring job-the non-decolorable print job (6) The decolorable print job-the decoloring job-the decolorable print job (7) The decolorable print job-the decoloring job-the non-decolorable print job-the decolorable print job (8) The decolorable print job-the non-decolorable print job-the decolorable print job In a case of (C) shown in FIG. 3 in which the upper limit temperature of the non-decolorable print job is lower than the upper limit temperature of the decolorable print job, following (9)~(12) combinations are considered as the combinations of the first to the third jobs and the processing procedures of the jobs.

(9) The decolorable print job-the decoloring job-the decolorable print job

(10) The non-decolorable print job-the decoloring job-the non-decolorable print job

(11) The non-decolorable print job-the decoloring job-the decolorable print job-the non-decolorable print job

Figure 4:
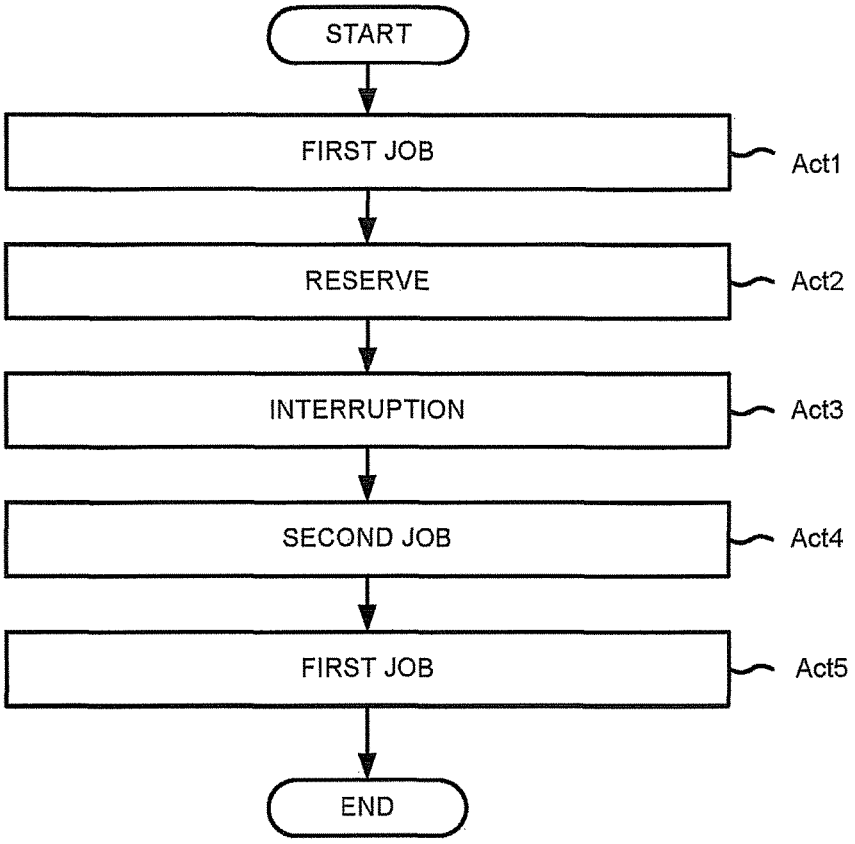
FIG. 4 is a flowchart illustrating an execution processing of jobs by a controller.
Figure 5:
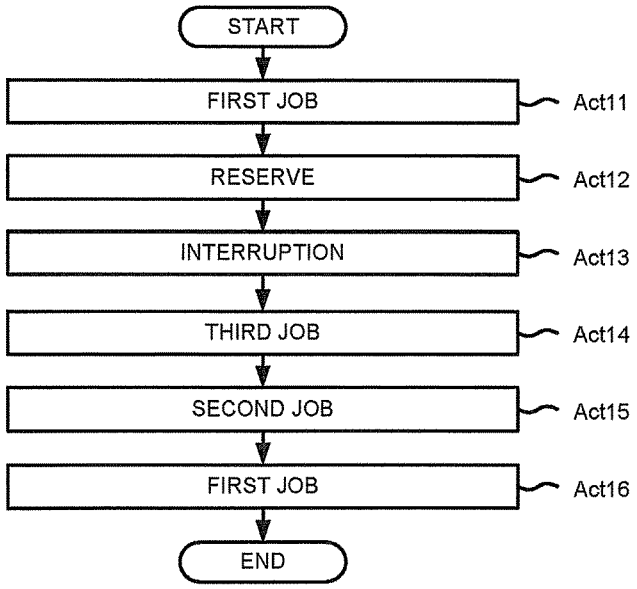
FIG. 5 is another flowchart illustrating the execution processing of jobs by the controller.
Figure 6:
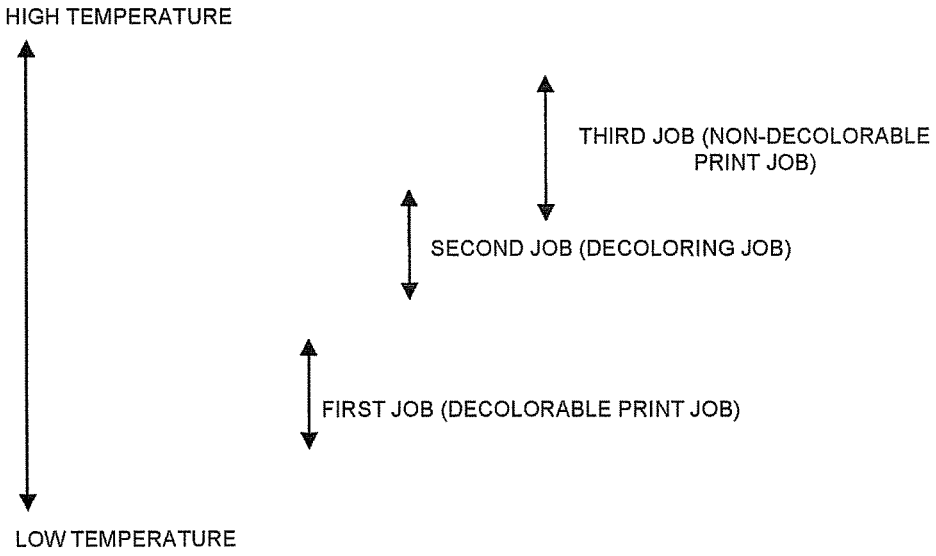
FIG. 6 is a diagram illustrating a relation of the temperature control ranges of the jobs.
Figure 8:
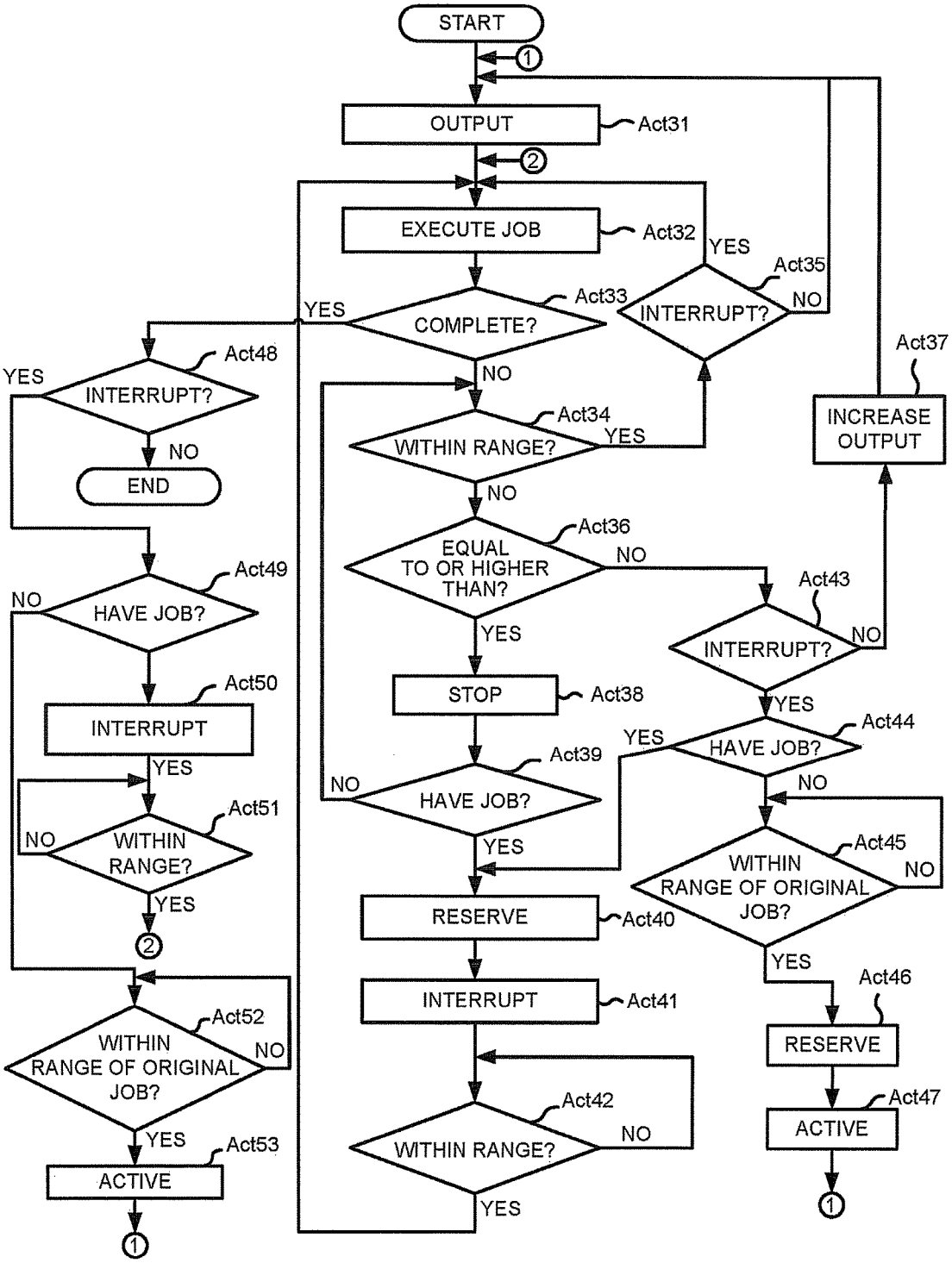
FIG. 8 is a detailed flowchart illustrating an execution processing of the jobs by the controller.

(12) The non-decolorable print job-the decolorable print job-the non-decolorable print job The execution processing of the jobs by the controller 20 in FIGS. 4 and 5 is described in detail with reference to FIG. 8.

The controller 20 heats the heat roller 182 with the heater 181 and executes a job (Act 32) while executing the control of the temperature of the heat roller 182 (Act 31). As the job, the decolorable print job can be exemplified in a case of (B) shown in FIG. 3 in which the upper limit temperature of the non-decolorable print job is lower than the upper limit temperature of the decoloring job and higher than the upper limit temperature of the decolorable print job.

The controller 20 executes the processing in Act 31 in a case in which the job (for example, the decolorable print job) is being executed (NO in Act 33), and the temperature of the heat roller 182 is within the temperature control range (YES in Act 34), and in a case in which a job (job at the head of the job queue 23) is not interruptedly executed (NO in Act 35). In other words, the controller 20 continues the job (Act 32) while executing the control of the temperature of the heat roller 182 through the heater 181 (Act 31).

The controller 20 increases the output of the heater 181 to increase the temperature of the heat roller 182 (Act 37) in a case in which the temperature of the heat roller 182 is out of the temperature control range (NO in Act 34), the temperature of the heat roller 182 is lower than the temperature control range (NO in Act 36), and a job is not interruptedly executed (NO in Act 43).

The controller 20 stops the output of the heater 181 (Act 38) in a case in which the temperature of the heat roller 182 is out of the temperature control range (NO in Act 34), and the temperature of the heat roller 182 is higher than the temperature control range (YES in Act 36).

The controller 20 repeats the processing in Act 34~the processing of NO in Act 39 in a case in which there is no job (for example, the decoloring job or non-decolorable print job) (NO in Act 39) the upper limit temperature of which is equal to or lower than the temperature of the heat roller 182 and higher than that of the job that is being executed in the job queue 23. In this way, the temperature of the heat roller 182 decreases with the natural heat radiation as the time elapses and becomes equal to or lower than the upper limit temperature of the temperature control range of the job (for example, the decolorable print job) (YES in Act 34). The controller 20 restarts the job (Act 31 and Act 32) in a case of not interruptedly executing the job (NO in Act 35).

The controller 20 reserves the job (for example, the decolorable print job) that is being executed (Act 40) in a case in which there is the job (for example, the decoloring job or non-decolorable print job) (YES in Act 39) the upper limit temperature of which is equal to or lower than the temperature of the heat roller 182 and higher than that of the job that is being executed in the job queue 23.

The controller 20 enables the job of which the upper limit temperature is highest among the jobs the upper limit temperatures of which are equal to or lower than the temperature of the heat roller 182 to interrupt the head of the job queue 23 (Act 41). For example, in a case of (B) shown in FIG. 3, in a case in which there is the decoloring job and the non-decolorable print job as jobs of which the upper limit temperatures are equal to or lower than the temperature of the heat roller 182 in the job queue 23, the controller 20 enables the decoloring job to interrupt the head of the job queue 23 (Act 41).

The controller 20 waits for until the temperature of the heat roller 182 decreases as the time elapses and the temperature of the heat roller 182 becomes within the temperature control range of the job interruptedly executed (NO in Act 42).

The controller 20 executes the job in a state of stopping the output of the heater 181 (Act 32) if the temperature of the heat roller 182 becomes within the temperature control range (YES in Act 42). The controller 20 may slow the conveyance speed of the sheet passing through the heat roller 182 at the time of executing the job in a state of stopping the output of the heater 181 compared with a case in which the job is executed in a state of carrying out the output of the heater 181.

The controller 20 continues the job in a state of stopping the output of the heater 181 (Act 32) in a case in which the temperature of the heat roller 182 is within the temperature control range (NO in Act 33, and YES in Act 34) and the job is interruptedly executed (YES in Act 35).

The controller 20 executes the following processing in a case in which the temperature of the heat roller 182 decreases to become equal to or lower than the temperature control range through executing the job in a state of stopping the output of the heater 181 (NO in Act 33, NO in Act 34, and NO in Act 36), and in a case in which the job is interruptedly executed (YES in Act 43).

The controller 20 returns to the processing in Act 40 in a case in which there is a job of which the upper limit temperature is lower than the temperature control range the job that is being executed in the job queue 23 (YES in Act 44). For example, in a case in which there is the non-decolorable print job of which the upper limit temperature is lower than the temperature control range of the decoloring job that is being executed in the job queue 23 (YES in Act 44), the controller 20 reserves the decoloring job that is being executed (Act 40), and enables the non-decolorable print job to interrupt the head (Act 41). Further, in the processing of YES in Act 44, a case in which there is only an original job (for example, the decolorable print job) that is executed through the output of the heater 181 in the job queue 23 is excluded.

In this way, the controller 20 can execute the non-decolorable print job with the residual heat of the heat roller 182 after executing the decoloring job the upper limit temperature of which is highest in a case in which the temperature of the heat roller 182 is high at the time of executing the decolorable print job, for example.

The controller 20 executes the following processing in a case in which the temperature of the heat roller 182 becomes equal to or lower than the lower limit temperature of the job that is interruptedly executed in the execution the job, and in a case in which there is no job of which the upper limit temperature is lower than the temperature control range of the job that is being executed in the job queue 23 (NO in Act 44).

The controller 20 executes the following processing in a case in which the temperature of the heat roller 182 is within the temperature control range of the original job (for example, the decolorable print job) that is executed through the output of the heater 181 (YES in Act 45). The controller 20 enables the original job to be the active state (Act 47) after reserving the job (for example, non-decolorable print job) that is being executed (Act 46). The controller 20 executes the original job (Act 31, and Act 32).

The controller 20 executes the original job (Act 46, Act 47, Act 31, and Act 32) in a case in which the temperature of the heat roller 182 is higher than the temperature control range of the original job (for example, the decolorable print job) that is executed through the output of the heater 181 (NO in Act 45) and if the temperature of the heat roller 182 decreases as the time elapses and becomes within the temperature control range of the original job (YES in Act 45).

In this way, the controller 20 can execute the non-decolorable print job with the residual heat of the heat roller 182 after executing the decoloring job of which the upper limit temperature is highest in a case in which the temperature of the heat roller 182 is high at the time of executing the decolorable print job, for example. Then, the controller 20 can restart the original decolorable print job if the temperature of the heat roller 182 decreases to become within the temperature control range of the original decolorable print job.

The controller 20 terminates the processing if the job is completed (YES in Act 33), and in a case in which the job is not interruptedly executed, in other words, the job is the original job (for example, the decolorable print job) that is executed through the output of the heater 181 (NO in Act 48). Further, the controller 20 restarts a reserved job in order after completing the job in a case in which there is the reserved job (for example, the decoloring job or non-decolorable print job).

The controller 20 executes the following processing if the job is completed (YES in Act 33), and in a case in which the job (for example, the decoloring job) is interruptedly executed (YES in Act 48).

The controller 20 executes the interruption of a job (Act 50) in a case in which there is the job (for example, the non-decolorable print job) of which the upper limit temperature is lower than that of the completed job (for example, the decoloring job) in the job queue 23 (YES in Act 49). Further, in the processing of YES in Act 49, a case in which there is only the original job (for example, the decolorable print job) that is executed through the output of the heater 181 in the job queue 23 is excluded.

The controller 20 executes the job (for example, the non-decolorable print job) (Act 32) in a case in which the temperature of the heat roller 182 is within the temperature control range of the job (for example, the non-decolorable print job) (YES in Act 51). The controller 20 executes the job (Act 32) in a case in which the temperature of the heat roller 182 is out of the temperature control range of the job (for example, the non-decolorable print job) (NO in Act 51), and if the temperature of the heat roller 182 becomes within the temperature control range as the time elapses (YES in Act 51).

The controller 20 executes the following processing in a case in which there is no job of which the upper limit temperature is lower than that of the completed job (for example, the decoloring job) in the job queue 23 (NO in Act 49).

The controller 20 enables the job to be the active state (Act 53) to execute the job (Act 31, and Act 32) in a case in which the temperature of the heat roller 182 is within the temperature control range of the reserved original job (for example, the decolorable print job) (YES in Act 52).

The controller 20 executes the job (Act 53, Act 31, and Act 32) in a case in which the temperature of the heat roller 182 is higher than the temperature control range of the reserved original job (for example, the decolorable print job) (NO in Act 52), and if the temperature of the heat roller 182 is within the temperature control range of the original job as the time elapses (YES in Act 52).

As stated above in detail, according to the technology described in the description, a technology of using the residual heat of the heating member can be supplied.

Other than in the operating examples, if any, or where otherwise indicated, all numbers, values and/or expressions referring to parameters, measurements, conditions, etc., used in the specification and claims are to be understood as modified in all instances by the term "about."

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image forming section configured to form an image on an image receiving medium with a color material;

a heating member configured to heat the image receiving medium;

a heater configured to heat the heating member;

a sensor configured to detect a temperature of the heating member; and a controller configured to execute a print job for forming an image on the image receiving medium with the image forming section and fixing the image on the image receiving medium with the heating member and a decoloring job for decoloring the image on the image receiving medium with the heating member and interruptedly execute an executable job in a state of stopping output of the heater in a case in which the temperature of the heating member is higher than a temperature control range of a job of which priority is highest and there is the executable job at the temperature of the heating member.

2. The image forming apparatus according to claim 1, wherein the image forming section comprises a first image forming section configured to form an image on the image receiving medium with a non-decolorable color material; and a second image forming section configured to form an image on the image receiving medium with a decolorable color material, and the print job comprises a non-decolorable print job for forming an image on the image receiving medium with the non-decolorable color material through the first image forming section and fixing the image on the image receiving medium with the heating member and a decolorable print job for forming an image on the image receiving medium with the decolorable color material through the second image forming section, and fixing the image on the image receiving medium with the heating member.

3. The image forming apparatus according to claim 2, wherein an upper limit temperature of a temperature control range of the heating member in the non-decolorable print job is lower than an upper limit temperature of a temperature control range of the heating member in the decoloring job, and the controller interruptedly executes the decoloring job in a state of stopping output of the heater in a case in which the temperature of the heating member is higher than the temperature control range of the non-decolorable print job and there is the decoloring job that is executable at the temperature of the heating member in the execution of the non-decolorable print job.

4. The image forming apparatus according to claim 2, wherein an upper limit temperature of a temperature control range of the heating member in the decolorable print job is lower than an upper limit temperature of a temperature control range of the heating member in the decoloring job, and the controller interruptedly executes the decoloring job in a state of stopping output of the heater in a case in which the temperature of the heating member is higher than the temperature control range of the decolorable print job and there is the decoloring job that is executable at the temperature of the heating member in the execution of the decolorable print job.

5. The image forming apparatus according to claim 1, wherein the controller slows a conveyance speed of the image receiving medium passing through the heating member at the time of executing a job in a state of stopping the output of the heater compared with a case of executing the job through the output of the heater.

6. An image forming apparatus, comprising:

a first image forming section configured to form an image on an image receiving medium with a non-decolorable color material;

a second image forming section configured to form an image on the image receiving medium with a decolorable color material;

a heating member configured to heat the image receiving medium;

a heater configured to heat the heating member;

a sensor configured to detect a temperature of the heating member; and a controller configured to execute a non-decolorable print job for forming an image on the image receiving medium with the non-decolorable color material through the first image forming section and fixing the image on the image receiving medium with the heating member and a decolorable print job for forming an image on the image receiving medium with the decolorable color material through the second image forming section and fixing the image on the image receiving medium with the heating member, interruptedly executes an executable job in a state of stopping output of the heater in a case in which the temperature of the heating member is higher than a temperature control range of a job of which priority is highest and there is the executable job at the temperature of the heating member.

7. The image forming apparatus according to claim 6, wherein an upper limit temperature of a temperature control range of the heating member in the decolorable print job is lower than an upper limit temperature of a temperature control range of the heating member in the non-decolorable print job, and the controller interruptedly executes the non-decolorable print job in a state of stopping output of the heater in a case in which the temperature of the heating member is higher than the temperature control range of the decolorable print job and there is the non-decolorable print job that is executable at the temperature of the heating member in the execution of the decolorable print job.

8. A method for executing a job by an image forming apparatus comprising a heating member configured to heat an image receiving medium and a heater configured to heat the heating member, comprising:

detecting a temperature of the heating member; and interruptedly executing an executable job in a state of stopping output of the heater in a case in which the detected temperature of the heating member is higher than a temperature control range of a job of which priority is highest and there is the executable job at the temperature of the heating member between a print job for forming an image on the image receiving medium and fixing the image on the image receiving medium with the heating member and a decoloring job for decoloring the image on the image receiving medium with the heating member.

9. The method according to claim 8, wherein the print job comprises a non-decolorable print job for forming an image on the image receiving medium with a non-decolorable color material and fixing the image on the image receiving medium with the heating member and a decolorable print job for forming an image on the image receiving medium with a decolorable color material and fixing the image on the image receiving medium with the heating member.

10. The method according to claim 8, wherein an upper limit temperature of a temperature control range of the heating member in the non-decolorable print job is lower than an upper limit temperature of a temperature control range of the heating member in the decoloring job, and executing the decoloring job in a state of stopping output of the heater in a case in which the temperature of the heating member is higher than the temperature control range of the non-decolorable print job and there is the decoloring job that is executable at the temperature of the heating member in the execution of the non-decolorable print job.

* * * * *